United States Patent [19]

Rounkles et al.

[11] Patent Number: 4,530,466

[45] Date of Patent: Jul. 23, 1985

[54] SPRAY NOZZLE

[75] Inventors: Rodney G. Rounkles, Excelsior Springs; Billy W. Holder, Rayville, both of Mo.

[73] Assignee: Ethyl Molded Products Company, Richmond, Va.

[21] Appl. No.: 505,384

[22] Filed: Jun. 17, 1983

[51] Int. Cl.[3] ..... B05B 7/32

[52] U.S. Cl. ..... 239/327; 222/211; 239/434

[58] Field of Search ..... 239/327, 334, 342, 428, 239/434; 222/211, 402.19

[56] References Cited

U.S. PATENT DOCUMENTS

| | | | |
|---|---|---|---|
| 2,571,921 | 10/1951 | Morris | 239/327 |
| 2,676,060 | 4/1954 | Montenier | 239/327 |
| 2,987,261 | 6/1961 | McCuiston et al. | 239/327 |
| 3,176,883 | 4/1965 | Davis, Jr. | 222/211 |
| 3,447,551 | 6/1969 | Braun | 222/402.19 |
| 3,679,137 | 7/1972 | Marchant | 239/327 |
| 4,122,979 | 10/1978 | Laauwe | 222/211 |

*Primary Examiner*—Andres Kashnikow
*Assistant Examiner*—Michael J. Forman
*Attorney, Agent, or Firm*—Donald L. Johnson; John F. Sieberth; E. Donald Mays

[57] ABSTRACT

This invention relates to a spray nozzle for fitment to a "squeeze" container. The nozzle features a gas-liquid mixing chamber which provides for axial and radial mixing of fluids in the container during the dispensing cycle. The spray nozzle of this invention provides a spray dispensing mode even when the container is inverted.

17 Claims, 7 Drawing Figures

SPRAY NOZZLE

This invention relates to a spray nozzle for fitment to a "squeeze" container. The nozzle provides a spray dispensing mode even when the container is in the inverted position.

BACKGROUND OF THE INVENTION

Products such as liquid medicaments and toiletries have long been packaged in "squeeze" containers which, along with a spray nozzle fitted to the container neck, dispense the product in spray form. The "squeeze" containers are generally made of a thermoplastic material and have sidewalls which are resiliently deformable. The spray nozzle is fitted with a dip tube which extends from a point adjacent the nozzle's gas-liquid mixing chamber to a point beneath the level of the product in the container. A nozzle dispensing orifice contiguous with the mixing chamber provides the pathway for the liquid product to be dispensed from the container.

In use, the container is squeezed, usually by applying finger pressure to the container sidewalls. Such squeezing deforms the container so that its interior volume is decreased. Concomitant with the decrease in the interior volume, there is an increase in internal pressure. When the container is in a substantially upright position, product, under the influence of the increased pressure, is forced up the dip tube into the gas-liquid mixing chamber. Simultaneously, gas, usually air within the container, is forced into the gas-liquid mixing chamber to mix with the product and to cause same to be dispensed through the dispensing orifice as a spray. When the container is in the substantially inverted position, the gas and product are still routed to the gas-liquid mixing chamber. However, their routes are reversed—the gas being routed via the dip tube and the product being routed via the route followed by the gas when the container is in the upright position. This rerouting results, in most conventional spray nozzles, in the product being dispensed as a stream. When the product is a medicament, e.g., nasal spray, mis-dosage can occur. If the product is a toiletry, product waste and misapplication occur.

The inability to provide a spray dispensing mode in the inverted position is a result of poor gas-product mixing which is believed due to the configuration of the gas-liquid mixing chamber and the relative amounts of gas and product reaching the chamber. In the upright position, the mixing chamber configuration provides adequate gas product mixing while in the inverted position, such mixing is inadequate.

Therefore, it is an object of this invention to provide a spray nozzle for use on "squeeze" containers which nozzles have a gas-liquid mixing chamber which is configured to produce a spray dispensing mode irrespsective of container position.

THE INVENTION

This invention relates to an integrally formed spray nozzle fittable, in a substantially fluid-tight manner, to the mouth of a container. Preferably, the container is a "squeeze" container, i.e., it has a portion which can be resiliently deformed to increase the pressure within the interior of the container to dispense the product therefrom. The spray nozzle has structure for attaching it to the container mouth. For example, this structure may comprise an annular wall downwardly extending from the end wall of the nozzle and having about its outside surface an outwardly extending annular bead. This annular bead is dimensioned to achieve a snap fit with an annular recess in and adjacent to the container mouth. Other suitable structure may be utilized, for example, the just-described annular wall can, in place of the annular bead, have a helical thread about its inside surface for cooperation with a helical thread about the container mouth. Other means for obtaining a fluid-tight fitment between the spray nozzle of this invention and a container may also be utilized.

The spray nozzle has an end wall having a planar inside wall portion with a dispensing orifice therethrough. Extending downwardly of the planar inside wall portion is a boss having a circular wall concentric with the dispensing orifice, which wall is substantially parallel to the planar inside wall portion of the end wall. A recess is provided in the circular planar boss wall. This recess will provide at least a portion of a gas-liquid mixing chamber which is in fluid communication with the dispensing orifice. The configuration of the gas-liquid mixing chamber contributes to the capability of the spray nozzle of this invention to provide a spray dispensing mode, irrespective of the position of the spray nozzle. The recess has substantially parallel and opposed first and second planar walls which are of equal length. The first and second planar walls lie along first and second chords, respectively, of the circle defined by the circular planar wall. Also provided by the spray nozzle of this invention is structure for providing substantially axial introduction of fluid into the gas-liquid mixing chamber and other structure for providing substantially radial introduction of fluid into the gas-liquid mixing chamber. The simultaneous radial and axial introduction of fluid into the gas-liquid mixing chamber causes break-up of the liquid product so that it is dispensed is dispensed in a spray form. When a container fitted with the spray nozzle of this invention is in the upright position, liquid product will be axially introduced into the gas-liquid mixing chamber while the gas within the container, e.g., air, will be introduced radially into the gas-liquid mixing chamber. If the container is in the inverted position, the liquid product will be introduced radially into the gas-liquid mixing chamber while the air within the container will be axially introduced into this same chamber.

Preferably, the structure to provide axial introduction of fluid into the gas-liquid mixing chamber comprises a hollow dip tube which has its proximate end held in close proximity to and concentric with the circular planar boss wall. The dip tube can be held in this position by placement of it into the bore of a collar which extends downwardly of the planar inside wall portion of the end wall. When such a collar is utilized, radial introduction of fluid in the gas-liquid mixing chamber can be provided by at least one groove in the annular wall which defines the collar bore. This groove would extend axially from the gas-liquid mixing chamber to the downwardmost extent of the bore. In the most preferred form, there are two of such grooves oppositely positioned from one another.

The configuration of the gas-liquid mixing chamber is important to the proper operation of the spray nozzle of this invention. To provide the proper proportion, the chords, upon which the first and second planar walls lie, should each subtend an angle, measured from the center of the circle defined by the circular planar wall, within the range of from about 30° to about 55°. A particularly preferred spray nozzle is one in which each chord subtends an angle within the range of from about 43° to about 48° and in which the circle defined by the circular planar wall has a diameter of from about 0.080 to 0.150 inches. In this particularly preferred spray nozzle, the first and second planar walls will have a height of from about 0.015 to about 0.040 inches and the dispensing orifice will have a diameter of from about 0.020 to about 0.040 inches.

The spray nozzle of this invention can be conventionally injection molded from various thermoplastic materials such as high density polyethylene, polypropylene, polyethylene terephthalate, etc.

These and other features of this invention contributing to satisfaction in use and economy of manufacture will be more fully understood from the following description of the preferred embodiment in the accompanying drawings in which identical numerals refer to identical parts and in which.

Figure 1:
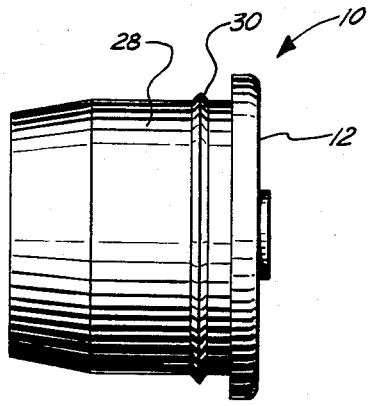
FIG. 1 is a side elevational view of a spray nozzle of this invention.
Figure 2:
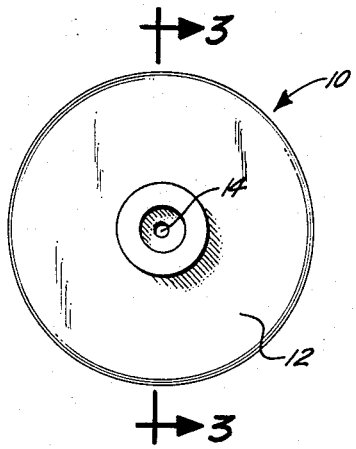
FIG. 2 is a front elevational view of the spray nozzle shown in FIG. 1.
Figure 3:
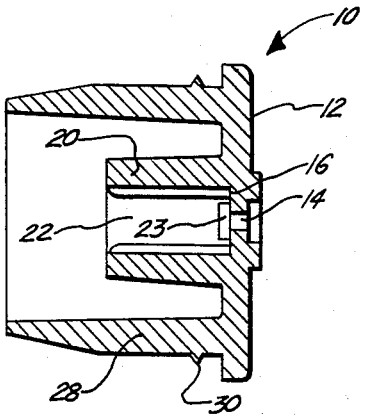
FIG. 3 is a sectional view taken through section lines 3—3 in FIG. 2.
Figure 4:
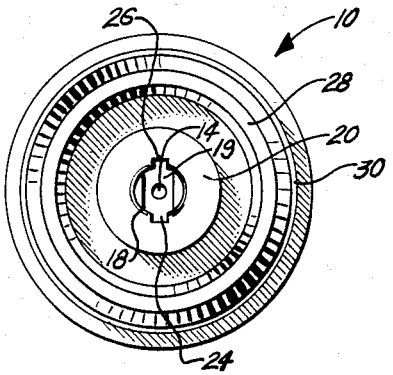
FIG. 4 is a rear elevational view of the spray nozzle shown in FIG. 1.
Figure 5:
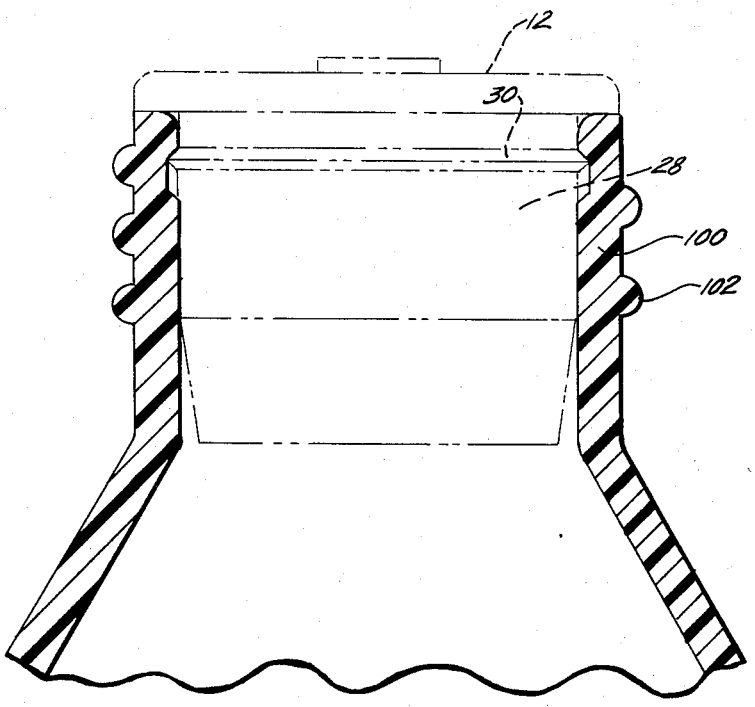
FIG. 5 is a sectional view showing the spray nozzle in FIG. 1 fitted to a container.
Figure 7:
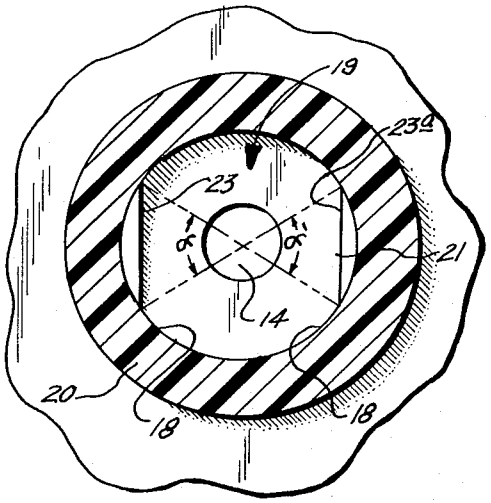
FIG. 7 is sectional view taken through section lines 7—7 in FIG. 6.

In FIGS. 1–7, there is shown a spray nozzle of this invention, generally designated by the numeral 10. Spray nozzle 10 has an end wall 12 with an annular wall 28 outwardly depending therefrom. About the outside surface of annular wall 28 is annular bead 30. As is seen in FIG. 5, annular bead 30 achieves a snap fit with annular recess 29 cut into the inside wall of container neck 100. Note that there is also provided helical thread 102 about the outside wall of container neck 100, which thread may be utilized to removably fit and overcap to the container.

Figure 6:
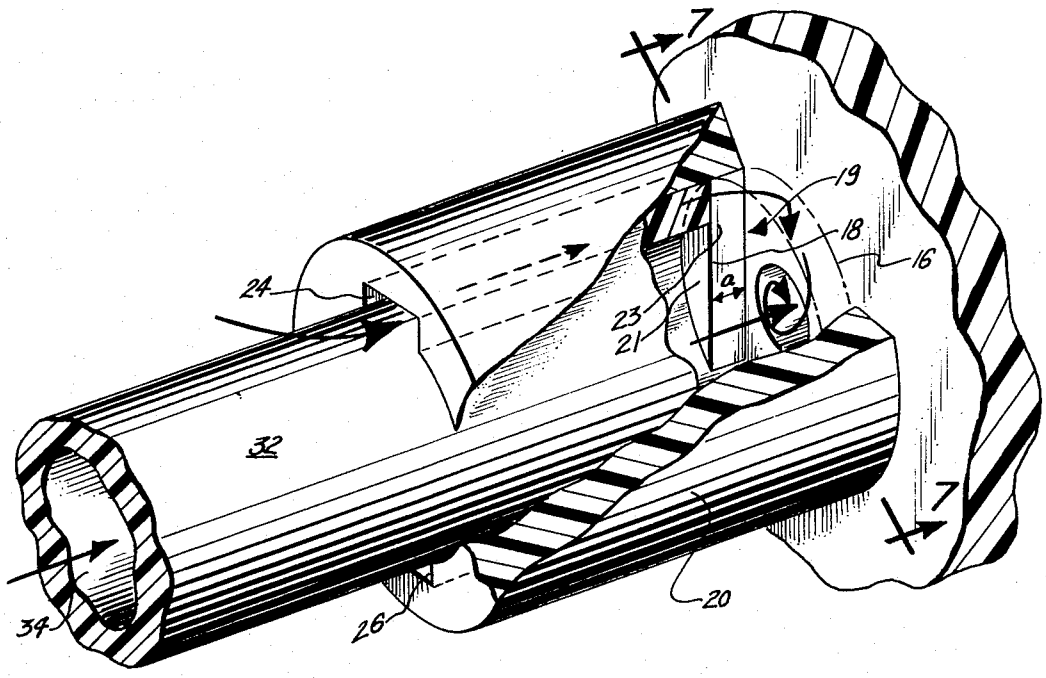
FIG. 6 is an enlarged, partially broken away, perspective view of a portion of the spray nozzle shown in FIG. 1 with a dip tube attached thereto.

End wall 12 has a planar inside wall portion 16 with a dispensing orifice 14 therethrough. Extending outwardly of the planar inside wall 16 is boss 18. Boss 18 has a circular planar boss wall 21. As can be seen in FIGS. 4 and 6, circular planar boss wall 21 has a recess 19 therein. Recess 19 is in fluid communication with dispensing orifice 14 and forms at least a portion of a gas-liquid mixing chamber. Recess 19 is defined on two of its opposed sides by first and second planar walls 23 and **23*a*. These two walls are parallel to one another and are of equal length. First and second planar walls 23 and 23*a* lie along first and second chords, respectively, of the circle defined by circular planar boss wall 21. As in seen in FIG. 7, the chords along which first and second planar walls 23 and 23*a* lie subtend angles $\alpha$ and $\alpha'$ respectively. In FIG. 6, the height of first planar wall is designated by the letter "a". The height of second planar wall 23*a* is not shown in the drawing but is of identical dimension to height "a" of first planar wall 23. Surrounding circular planar boss wall 21 is collar 20. Collar 20 has a bore dimensioned to receive by force fit dip tube 32. Dip tube 32 has a bore 34 through which fluid can pass to the gas-liquid mixing chamber provided by recess 19. Note that fluid passing through bore 34** will enter the mixing chamber in an axial direction.

Grooves 24 and 26 are provided in the annular wall of the bore of collar 20. As seen in FIG. 6, these grooves are oppositely opposed and extend from the gas-liquid mixing chamber to the outwardmost extent of collar 20. So that there will be sufficient mixing of the gas and liquid in the gas-liquid mixing chamber, the ratio of the cross-sectional area provided by these two grooves to the cross-sectional area provided by bore 34 of dip tube 32 falls within the range of about 1.25 to about 1.75. A ratio of about 1.5 is most highly preferred when the liquid to be dispensed has a viscosity similar to that of water. If the cross-sectional area of grooves 24 and 26 is too large with respect to the cross-sectional area of bore 34, a spray mode of dispensing may not occur when the container is in the inverted position.

In operation, the spray nozzle of this invention provides that, when the container is in the upright position, liquid will enter into the gas-liquid mixing chamber via bore 34 while the gas within the container will enter the same chamber via grooves 24 and 26. In this position, the liquid enters the mixing chamber axially while the gas enters the mixing chamber radially. The resultant mixing allows for spray mode dispensing of the liquid through orifice 14. When the container is in the inverted position, the gas within the container will enter the gas-liquid mixing chamber via bore 34 while the liquid will enter the same chamber via grooves 24 and 26. Once again, mixing of the gas and liquid in the chamber results in a spray mode of dispensing through orifice 14. By having the gas-liquid mixing chamber configured in accordance with the principles of this invention and by having the beforedescribed relationship between the cross-sectional area of grooves 24 and 26 and bore 34, the liquid will be dispensed from the container in a spray mode, even when the container is in an inverted position.

Return of atmospheric gas into the container will occur after the resiliently deformable portion of the container is allowed to return to its original position. The path taken by the atmospheric gas will be dependent upon whether or not the container is in the upright or inverted position. In the upright position, atmospheric gas will return to the interior of the container via grooves 24 and 26. In the inverted position, atmospheric gas will return to the container's interior via bore 34.

We claim:

1. An integral spray nozzle for fitment to a container mouth, said spray nozzle comprising:

(a) means for fitting said spray nozzle to said container mouth in a substantially fluid-tight manner;

(b) an end wall having a planar inside wall portion with a dispensing orifice therethrough;

(c) a boss extending outwardly of said planar inside wall portion and having a circular planar boss wall which is concentric with said dispensing orifice and substantially parallel to said planar inside wall portion;

(d) a recess in said circular planar boss wall which provides at least a portion of a gas-liquid mixing chamber which is in fluid communication with said dispensing orifice, said recess having substantially parallel and opposed first and second planar walls of equal length, said first and second planar walls lying along first and second chords, respectively, of the circle defined by said circular planar wall;

(e) a first means for providing substantially axial introduction of one of a gas or a liquid into said gas-liquid mixing chamber; and (f) a second means for providing substantially radial introduction of the other of said gas or said liquid into said gas-liquid mixing chamber.

2. The integral spray nozzle of claim 1 wherein said fitting means of (a) comprises an annular wall downwardly extending from said end wall and having an outwardly extending annular bead, said bead being configured and dimensioned to achieve a snap fit with an annular recess in and adjacent the container mouth.

3. The integral spray nozzle of claim 2 wherein said first means comprises a hollow dip tube having its proximate end held in close proximity to and concentric with circular planar boss wall.

4. The spray nozzle of claim 3 wherein said dip tube is held within a bore provided by said annular wall.

5. The integral spray nozzle of claim 4 wherein said second means comprises at least one groove in said annular wall defining said bore, said groove extending axially from said gas-liquid mixing chamber to the lower end of said bore.

6. The integral spray nozzle of claim 5 wherein there are two grooves oppositely positioned from one another.

7. The integral spray nozzle of claim 5 wherein said chords subtend an angle from the center of said circle within the range of from about 30° to 55° and the ratio of the cross-sectional area provided by said at least one groove and, the cross-sectional area of said bore of said dip tube falls within the range of from about 1.25 to about 1.75.

8. The integral spray nozzle of claim 3 wherein said chords subtend an angle from the center of said circle within the range of from about 30° to 55°.

9. The integral spray nozzle of claim 1 wherein said chords each subtend an angle, from the center of said circle, within the range of from about 30° to 55°.

10. A package suitable for dispensing liquid products, said package comprising:

a container having a mouth and a resiliently deformable body portion; and an integral spray nozzle having:

(a) means for fitting said spray nozzle to said container mouth in a substantially fluid-tight manner;

(b) an end wall having a planar inside wall portion with a dispensing orifice therethrough;

(c) a boss extending downwardly of said planar inside wall portion and having a circular planar boss wall which is concentric with said dispensing orifice and substantially parallel to said planar inside wall portion;

(d) A recess in said circular planar boss wall which provides at least a portion of a gas-liquid mixing chamber which is in fluid communication with said dispensing orifice, said recess having substantially parallel and opposed first and second planar walls of equal length, said first and second planar walls lying along first and second chords, respectively, of the circle defined by said circular planar wall;

(e) a first means for providing substantially axial introduction of one of a gas or a liquid into said gas-liquid mixing chamber; and (f) a second means for providing substantially radial introduction of the other of said gas or said liquid into said liquid mixing chamber.

11. The integral spray nozzle of claim 10 wherein said chords each subtend an angle, from the center of said circle, within the range of from about 30° to 55°.

12. The integral spray nozzle of claim 10 wherein said fitting means of (a) comprises an annular wall downwardly extending from said end wall and having an outwardly extending annular bead, said bead being configured and dimensioned to achieve a snap fit with an annular recess in and adjacent the container mouth.

13. The integral spray nozzle of claim 12 wherein said first means comprises a hollow dip tube having its proximate end held in close proximity to and concentric with said circular planar boss wall.

14. The spray nozzle of claim 13 wherein said dip tube is held within a bore provided by said annular wall.

15. The integral spray nozzle of claim 14 wherein said second means comprises at least one groove in said annular wall defining said bore, said groove extending axially from said gas-liquid mixing chamber to the lower end of said bore.

16. The integral spray nozzle of claim 15 wherein there are two grooves oppositely positioned from one another.

17. The integral spray nozzle of claim 15 wherein said chords subtend an angle from the center of said circle within the range of from about 30° to 55° and the ratio of the cross-sectional area provided by said at least one groove and, the cross-sectional area of said bore of said dip tube falls within the range of from about 1.25 to 1.75.

* * * * *